US007262679B2

(12) United States Patent
Mehdizadeh et al.

(10) Patent No.: US 7,262,679 B2
(45) Date of Patent: Aug. 28, 2007

(54) ROTARY TRANSFORMER

(75) Inventors: Mehrdad Mehdizadeh, Avondale, PA (US); Gary W. Foggin, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/489,180

(22) Filed: Jul. 19, 2006

(65) Prior Publication Data

US 2007/0120634 A1 May 31, 2007

Related U.S. Application Data

(60) Provisional application No. 60/700,416, filed on Jul. 19, 2005.

(51) Int. Cl.
*H01F 27/32* (2006.01)

(52) U.S. Cl. ..... 336/84 R

(58) Field of Classification Search ..... 336/84 C, 336/84 M, 84 R, 115–119, 130–2; 310/85–86, 310/261
See application file for complete search history.

(56) References Cited

U.S. PATENT DOCUMENTS 4,820,945 A * 4/1989 Khutoretsky et al. ..... 310/52
5,661,353 A * 8/1997 Erdman et al. ..... 310/86
6,169,353 B1 * 1/2001 Driscoll et al. ..... 310/261
6,291,919 B1 * 9/2001 Ganti et al. ..... 310/261
7,053,509 B2 * 5/2006 Ryan et al. ..... 310/68 C

* cited by examiner

*Primary Examiner*—Tuyen T. Nguyen

(57) ABSTRACT

A rotary transformer for coupling electrical power at a high level into a rotor operable at a high rotational speed without the introduction of undesirable electromagnetic torque and problems of dynamic mechanical instability comprises a stationary primary mounted in surrounding relationship with respect to the rotor, an electromagnetic shield having an exterior surface thereon mounted to the rotor, and a secondary mounted on the exterior surface of the shield. The secondary is connected in an electrical circuit with the load such that the application of an alternating current having a frequency of at least one (1) kilohertz to the primary produces an alternating electromagnetic field having flux lines in the secondary in the secondary oriented generally parallel to the axis of rotation. The alternation of the electromagnetic field induces a voltage in the secondary that generates an electric current to the load. The shield isolates the rotor from the alternating electromagnetic field to prevent eddy current heating of the rotor.

7 Claims, 4 Drawing Sheets

ROTARY TRANSFORMER

CROSS REFERENCE TO RELATED APPLICATIONS

Subject matter disclosed herein may be disclosed in the following applications filed concurrently herewith, all assigned to the assignee of the present invention:

"Heating System and Temperature Control System For A Rotor", Ser. No. 11/489,120, (CL3189 US NA), filed in the names of Edward J. Delawski, Michael R. McQuade and Mehrdad Mehdizadeh; and "Pressure Control System For A Rotor", Ser. No. 11/489,123, (CL3192US NA), filed in the names of Edward J. Delawski, Michael R. McQuade and Mehrdad Mehdizadeh.

BACKGROUND OF THE INVENTION

1. Field of the Invention

This invention relates to a transformer for transferring electrical power into a machine member that is rotating at high speed.

2. Description of Related Art

In rotating mechanical systems there is often a need to transfer electrical power into a load mounted on a rotor operating at high rotational speeds.

A common method of power transfer is magnetic induction. A magnetic field is created with a stator. Movement of a coil mounted on the rotor through the magnetic field created by the stator generates an induced current in the coil according to Lenz's Law. The amount of power transferred is relative to the intensity of the magnetic field and the speed of rotor with respect to the stator. For low power transfer the magnetic field may be created by permanent magnets in the stator. For higher power transfer electromagnets are typically used to create the magnetic field.

The rotor speed determines the amount of power transferred into the rotor. As the electrical load on the rotor changes so does the torque load. This may cause the rotational speed of the rotor to change. Independently controlling the power delivered to the load in the rotor without affecting the rotational speed of the rotor thus presents practical problems.

One method of controlling the power delivery to an electrical load in a rotor independent of rotor speed is by the use of slip rings. Slip rings are typically mounted in an electrically insulated manner on the rotor and employ brushes mounted in an electrically insulated manner on the fixed stator element of the machine. The brushes are typically made of a relatively soft electrically conductive material, such as graphite, and are spring-loaded to maintain adequate contact with the slip rings. The brushes have limited service life due to wear while in use and must be periodically replaced. The rate of wear is a function of both the surface speed of the slip ring against the brush and the current being transferred. The surface speed is a function of the rotational speed and the slip ring diameter. An increase in surface speed accelerates the rate of brush wear. At high current levels and high surface speeds the slip rings tend to erode and must be periodically refurbished.

Due to the limited power transfer achievable, reliability, and environmental issues, slip ring/brush components have been eliminated from many applications.

At low alternating current frequencies, such as fifty (50) or sixty (60) Hertz line frequencies, ferrite or other high coercivity materials may be efficiently used within both the stator and the rotor to couple power into a rotating load.

However, to transfer significant amounts of power such high coercivity materials must be physically large and heavy. Large heavy masses of ferrite in the rotor can cause significant dynamic mechanical problems when the rotor is rotated at high speed.

Accordingly, in view of the foregoing, it is believed advantageous to provide a power transfer arrangement for transferring electrical power into a high speed, continuously operating, rotating member in an efficient and maintenance-free manner without introducing undesirable dynamic balance problems.

SUMMARY OF THE INVENTION

The present invention is directed to a rotary transformer for coupling electrical power at a high level into a rotating member operable at a high rotational speed without the introduction of undesirable electromagnetic torque and problems of dynamic mechanical instability.

The high power rotary transformer in accordance with the present invention comprises a stationary primary mounted in surrounding relationship with respect to the rotor, an electromagnetic shield having an exterior surface thereon mounted to the rotor, and a secondary mounted on the exterior surface of the shield. The secondary is connected in an electrical circuit with the load such that the application of an alternating current having a frequency of at least one (1) kilohertz to the primary produces an alternating electromagnetic field having flux lines in the secondary in the secondary oriented generally parallel to the axis of rotation. The alternation of the electromagnetic field induces a voltage in the secondary that generates an electric current to the load. The shield isolates the rotor from the alternating electromagnetic field to prevent eddy current heating of the rotor.

The stationary primary comprises a coil formed from a plurality of turns of an electrical conductor arranged in a single uniform layer coaxial with the axis of rotation. The single layer may be formed as a helix.

The secondary comprises a coil formed from a plurality of turns of an electrical conductor, the coil being arranged coaxially with the axis of rotation. The turns forming the coil may be arranged in a single uniform layer. Alternatively the secondary may comprise a plurality of coils, each with an axis therethrough. Each coil in the secondary is arranged with its axis parallel to the axis of rotation. The electrical load may comprise one or more electrical resistance heater(s), a radio frequency transmitter, or other loads.

BRIEF DESCRIPTION OF THE FIGURES

The invention will be more fully understood from the following detailed description taken in connection with the accompanying drawings, which form a part of this application and in which.

DETAILED DESCRIPTION OF THE INVENTION

Figure 1:
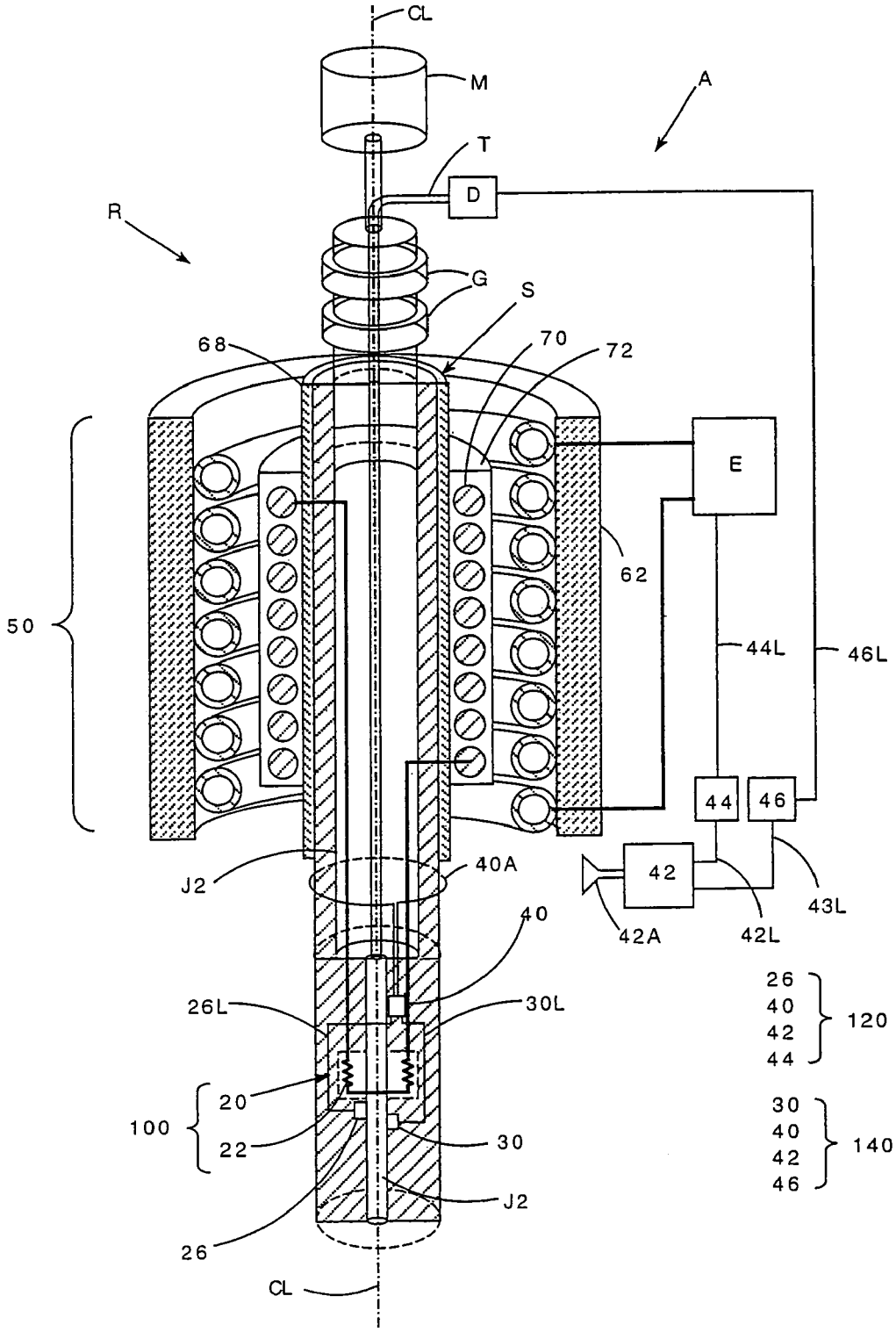
FIG. 1 is a stylized representation, partially in section, of a rotary apparatus that utilizes the present invention.

Throughout the following detailed description similar reference characters refer to similar elements in all figures of the drawings.

FIG. 1 is a stylized pictorial representation, partially in section, of a rotary apparatus generally indicated by reference character A. The overall apparatus A includes a rotor R comprising a shaft S. The shaft S has a stepped bore J extending thereof. The bore J includes a larger diameter upper portion J1 and a reduced diameter lower portion J2. A supply tube T extends centrally and axially through the upper portion J1 of the shaft S. The tube T supplies a fluid material at a predetermined regulated flow rate from a pump D into the lower portion J2 of the bore.

The rotor R is supported by bearings G for rotation about an axis of rotation CL. Motive force for the rotation of the rotor R is provided by a drive motor M.

The physical properties of the fluid material are influenced by the both its temperature and the pressure. Accordingly it is desirable to control both the temperature and the pressure of the fluid material as it passes through the rotor.

HEATING SYSTEM The present invention employs a heating system 100 for heating the body of the rotor R surrounding the lower portion J2 of the bore to a predetermined temperature level for any of a variety of purposes. Such purposes may include the heating of the fluid material passing therethrough.

The heating system 100 includes one or more heater assembly(ies) 20 arranged within the body of the shaft S. Each heater assembly 20 takes the form of one or more electrical resistance element(s) 22. The resistance heaters 22 are disposed in heat transfer relation within body of the shaft S in close proximity to the lower portion J2 of the bore.

Electrical energy at a high power level is applied to the heating element(s) 22 from a source E (FIG. 1) via a rotary transformer 50 (FIG. 1) in accordance with another aspect of the present invention. The structural and operational details of the rotary transformer 50 are fully described hereinafter.

TEMPERATURE CONTROL In accordance with another aspect of the present invention a temperature control system 120 (FIG. 1) is provided to control the temperature to which the fluid material is heated by the associated heating assembly 20.

The temperature control system 120 includes a temperature sensing element 26, a transmitter 40 and associated antenna 40A, a stationary receiver 42 and its associated antenna 42A, and a temperature controller 44. It is important that the signal between the transmitter and receiver be relatively constant. To this end at least one of the antennas 40A, 42A should take the form of a coil surrounding the rotor R. In FIG. 1 the transmitter antenna 40A is implemented by a coil mounted on the rotor R. Alternatively or additionally, the antenna 42A for the receiver 42 may be implemented by a coil surrounding the rotor R.

The temperature sensor 26 is mounted on the body of the rotor R in the vicinity of the lower portion J2 of the bore. The transmitter 40 is also mounted on the rotor R. The stationary receiver 42 is mounted in a convenient position external to the rotor R. The receiver 42 is connected to the temperature controller 44 over a line 42L.

In use, the temperature sensing element 26 is operative to generate an electrical signal representative the temperature of the rotor, and indirectly, the temperature of the fluid material flowing through the bore J2. Alternatively, the sensing element 26 may extend into the bore J2 and into direct thermal contact with a fluid material passing through the bore J2.

The temperature signal is applied to the transmitter 40 over a connection line 26L. The transmitter 40 receives the electrical signal from the temperature sensing element 26 and transmits a modulated radio frequency signal representative of the temperature to the receiver 42. The modulated radio frequency signal is received by the receiver 42 and applied to the temperature controller 44. The controller 44 is operative to generate a temperature control signal, which is applied over a control line 44L to control the power level of the source E.

PRESSURE CONTROL To control of the pressure of the fluid material supplied by the pump D to the bore J2, a pressure control system 140 is provided.

The pressure control system 140 includes a pressure sensing element 30, a transmitter, a stationary receiver and a pressure controller 46. It should be understood that in the preferred implementation the transmitter 40 and the receiver 42 used for temperature control system 120 can also be used for the pressure control system 140. Alternatively, an additional transmitter and receiver dedicated to the pressure control system 140 may be provided.

The pressure sensor 30 is mounted in the body of the rotor R and extends into the bore J2. The pressure sensor 30 senses the pressure of the fluid material within the bore J2 and generates an electrical signal representative thereof. The pressure signal is applied to the transmitter 40 over a connection line 30L. The transmitter 40 receives the electrical signal from the pressure sensing element 30 and transmits a modulated radio frequency signal representative of the pressure to the receiver 42. The modulated radio frequency signal is received by the receiver 42 and applied to the pressure controller 46 over a line 43L. The controller 46 is operative to generate a pressure control signal, which is applied over a control line 46L to control the flow rate of the fluid material from the pump D.

Although the temperature controller 44 and the pressure controller 46 are illustrated as separate systems it should be appreciated that these elements can be physically accommodated in the same housing. The modulated radio frequency signal from the transmitter 40 may be encoded to include the information representative of the temperature as well as information representative of the pressure. The receiver 42 may decode this information and supply the decoded signal to the appropriate controller.

Suitable temperature sensors and pressure sensors are silicon-on-sapphire ("SOS") sensors available from Sensonetics Corporation, Huntington Beach, Calif. Although the temperature sensor 26 and the pressure sensor 30 are illustrated separately a combined temperature/pressure sensor may be employed.

A suitable transmitter 40 and the receiver 42 are available from Wireless Data Corporation, Columbus, Ohio, a division of Sensotec Inc., a subsidiary of Honeywell Corporation, Minneapolis, Minn.

Electrical power needed to operate the temperature sensor 26, the pressure sensor 30, the transmitter 40 (and any additional transmitters, if provided) is coupled into the rotor R using the rotary transformer 50 described hereinafter.

Alternately, power for the sensors 26, 30 and the transmitter 40 may be supplied through the antennas 40A, 42A using as the receiver 42 an IPS/Receiver device available from Wireless Data Corporation.

Figure 2A:
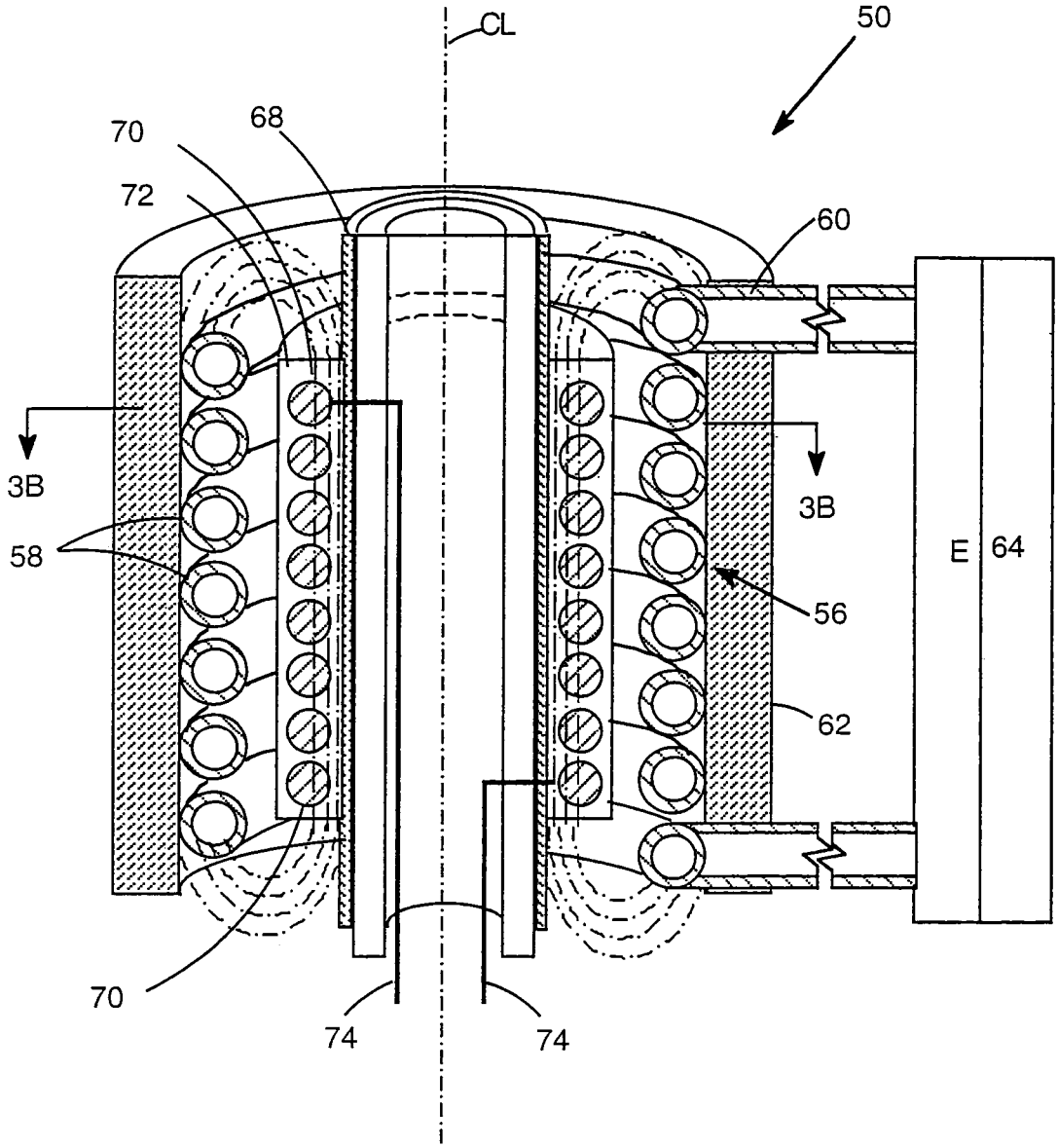
FIG. 2A is an enlarged view of a portion of FIG. 1 showing the rotary transformer of the present invention.
Figure 2B:
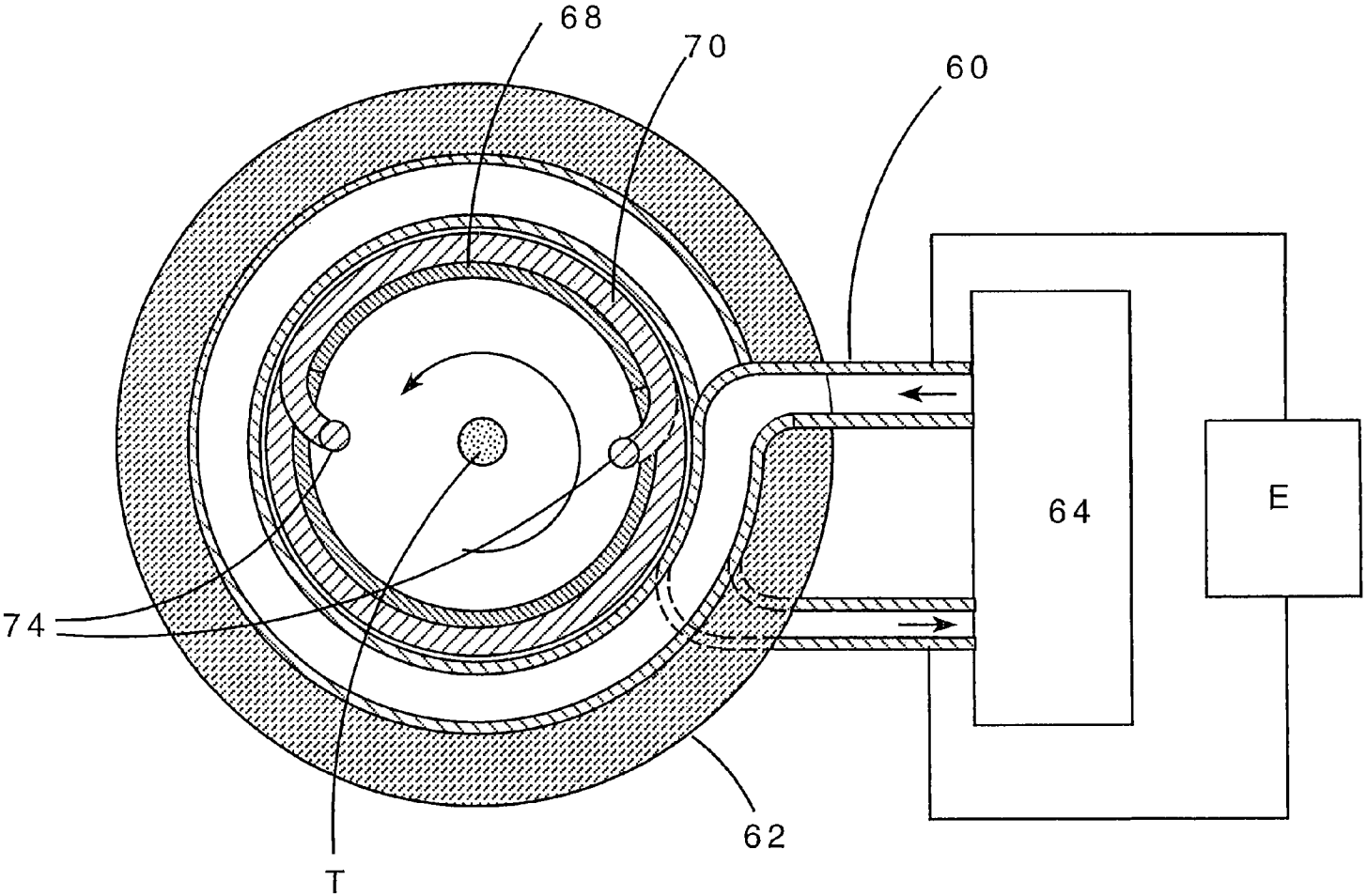
FIG. 2B is a sectional view taken along sections 2B-2B in FIG. 2A.

Shown in FIGS. 2A and 2B is a high power rotary transformer generally indicated by reference character 50 for coupling electrical energy at a high power level into the electrical loads in or on the rotor R. The electrical loads may comprise the electrical heater assembly(ies) 20, the temperature sensor 26, the pressure sensor 30 and the transmitter 40. As used in this application the term "high power" means electrical energy in the range of tens of kilowatts. The transformer 50 of the present invention is able to transfer such power levels efficiently into the electrical loads without inducing a deleterious electromotive torque on the rotor R.

The rotary transformer 50 may be located along the shaft S below the bearings G and adjacent the larger diameter upper portion J1 of the bore, as illustrated in FIG. 1. It should be understood, however, that the rotary transformer 50 may be located in any other convenient location along the shaft S, such as between the motor and the bearings or at the upper end of the shaft S above the motor M.

The transformer 50 includes a stationary electrical primary 56 mounted in surrounding coaxial relationship with respect to the rotor R. The primary 56 comprises a generally cylindrical winding formed from a plurality of turns 58 of an electrical conductor 60. Preferably the turns 58 of the electrical conductor 60 are arranged in a single helical layer. The winding is mechanically supported by a cylindrical housing 62. The stationary electrical primary 56 is electrically connected to the source E of alternating electrical current.

In the preferred instance the electrical conductor 60 forming the primary 56 takes the form of a hollow tubular conductor. The interior of the conductor 60 forms a conduit through which a coolant fluid from a cooling system 64 may flow to remove heat generated by resistive losses in the conductor 60.

In an alternative arrangement for cooling the primary the electrical conductor may be solid in form and mounted in thermal contact within a cylindrical housing. A tubular cooling element is wrapped in thermal contact with the exterior of the housing. Coolant fluid from the cooling system passes through the cooling element to remove heat from the primary. As yet another alternative arrangement for cooling the primary the housing may be provided with an array of radiating cooling fins.

An electromagnetic shield 68, typically in the form an aluminum cylinder, is mounted to the exterior of the rotor R. An electrical secondary 70 is mounted on the exterior surface of the shield 68. A thermally conductive electrically insulating material 72 may be provided about the secondary 70, if desired. The electrical secondary 70 is connected in an electrical circuit with the electrical loads by leads 74 disposed either on or within the rotor R.

In FIGS. 2A and 2B the secondary comprises a coil formed from a plurality of turns of an electrical conductor, the coil being arranged coaxially with the axis of rotation CL of the rotor R. As shown, the turns forming the coil are arranged in a single uniform layer.

The secondary 70 of the rotary transformer 50 may be used to implement the antenna 40A associated with the transmitter 40. Alternatively or additionally the primary 56 of the rotary transformer 50 may be used to implement the antenna 42A associated with the receiver 42.

Figure 3:
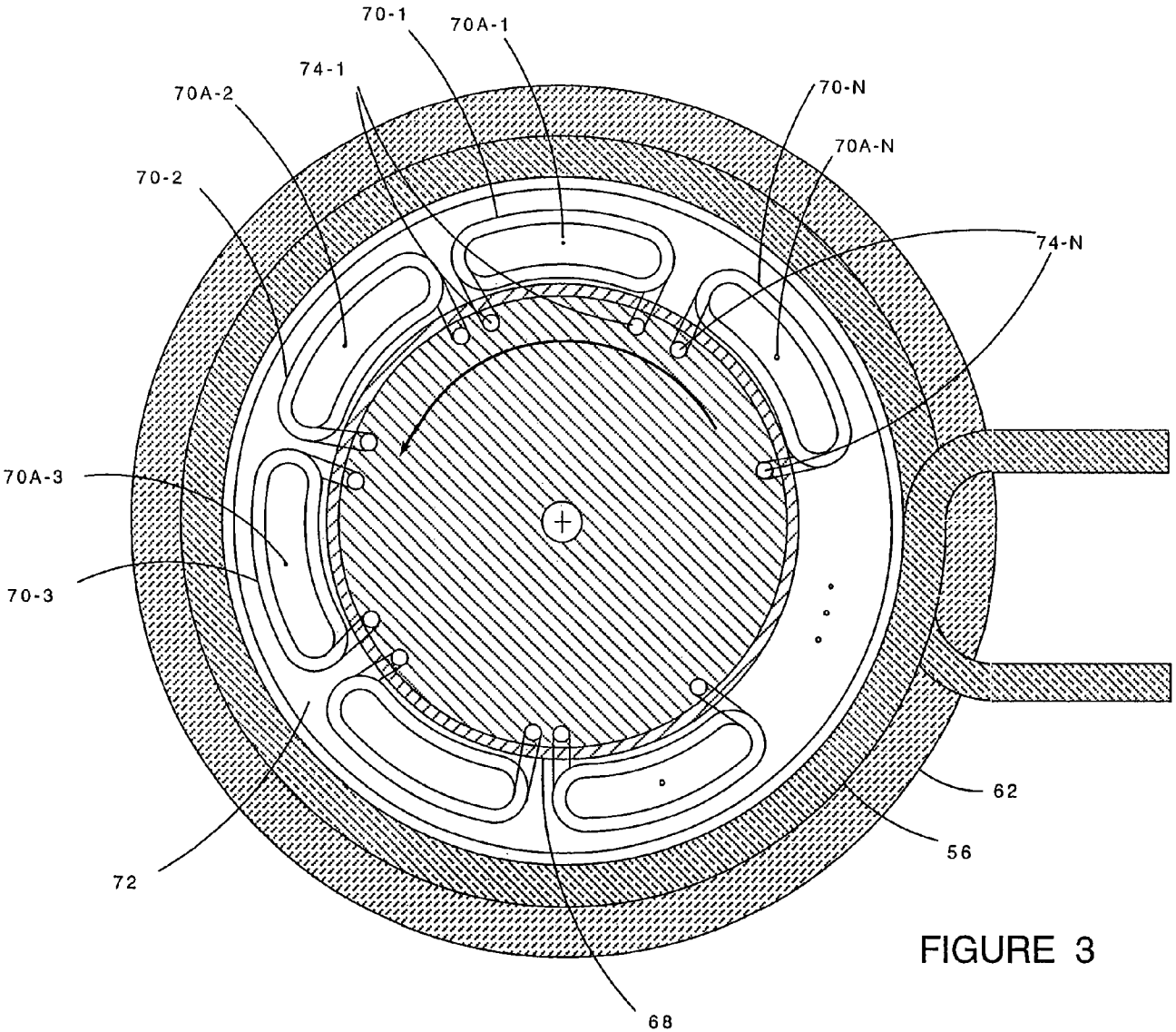
FIG. 3 is sectional view similar to FIG. 2B illustrating a rotor-mounted transformer secondary having a plurality of coils.

An alternative embodiment of the secondary of the transformer 50 is shown in FIG. 3. In this embodiment the secondary comprises a plurality of secondary coils 70-1 through 70-N. Each coil has a respective axis 70A-1 through 70A-N therethrough, with the axis of each coil arranged parallel to the axis of rotation CL. Electrical leads 74-1 through 74-N from each respective secondary coil 70-1 through 70-N are connected to a respective load (such as electrical heater assembly 20).

In operation, the application of an alternating current from the source E to the primary 56 produces a changing alternating electromagnetic field having flux lines in the secondary 70 oriented generally parallel to the axis CL of rotation. The alternation of the electromagnetic field induces a voltage in the secondary thereby generating an electric current to the load. The shield 68 isolates the rotor R from the alternating electromagnetic field thereby to prevent eddy current heating of the rotor R.

To obtain the advantages of coupling efficiency between the primary and secondary the alternating current generated by the source E must have a frequency far in excess of fifty/sixty (50/60) Hertz power line frequencies. The frequency of the source E is at least one kilohertz (1 kHz). More preferably, the frequency of the source E is at least ten kilohertz (10 kHz). As a consequence of the increased coupling efficiency due to operation above one kilohertz the need for heavy ferrite structures on the rotor is avoided.

Those skilled in the art, having the benefit of the teachings of the present invention as hereinabove set forth may effect modifications thereto. Such modifications are to be construed as lying within the contemplation of the present invention, as defined by the appended claims.

What is claimed is:

1. A high power rotary transformer for coupling electrical energy at a high power level into at least one electrical load mounted on a rotor rotatable about an axis of rotation, the transformer comprising:

a stationary primary mounted in surrounding relationship with respect to the rotor, an electromagnetic shield mounted to the rotor, the shield having an exterior surface thereon, and a secondary mounted on the exterior surface of the shield, the secondary being connected in an electrical circuit with the load, whereby the application of an alternating current having a frequency of at least one (1) kilohertz to the primary produces an alternating electromagnetic field having flux lines in the secondary oriented generally parallel to the axis of rotation, the alternation of the electromagnetic field inducing a voltage in the secondary thereby generating an electric current to the load, and whereby the shield isolates the rotor from the alternating electromagnetic field to prevent eddy current heating of the rotor.

2. The rotary transformer of claim 1 wherein the stationary primary comprises a coil formed from a plurality of turns of an electrical conductor arranged in a single uniform layer coaxial with the axis of rotation.

3. The rotary transformer of claim 2 wherein the single layer is formed as a helix.

4. The rotary transformer of claim 1 wherein the secondary comprises a coil formed from a plurality of turns of an electrical conductor, the coil being arranged coaxially with the axis of rotation.

5. The rotary transformer of claim 4 wherein the plurality of turns forming the coil is arranged in a single uniform layer.

6. The rotary transformer of claim 1 wherein the secondary comprises a plurality of coils, each coil has an axis therethrough, each coil in the secondary being arranged with its axis parallel to the axis of rotation.

7. The rotary transformer of claim 1 further comprising a plurality of individual electrical loads, and wherein the secondary comprises a plurality of coils, each coil has an axis therethrough, each coil in the secondary being arranged with its axis parallel to the axis of rotation, each coil being electrically connected to one of the individual electrical loads.

* * * * *